US006237973B1

(12) United States Patent
Dupont et al.

(10) Patent No.: US 6,237,973 B1
(45) Date of Patent: May 29, 2001

(54) ASH AND DEBRIS COLLECTOR AND BAGGER

(76) Inventors: André Dupont, 960 Marie-Victorin, Boucherville, Quebec (CA), J4B 1Y8; Bao Chieng, 7370 Lacordâire, St. Leonard (CA), H1S 2A4

( * ) Notice: Subject to any disclaimer, the term of this patent is extended or adjusted under 35 U.S.C. 154(b) by 0 days.

(21) Appl. No.: 09/260,827

(22) Filed: May 11, 1999

(51) Int. Cl.[7] ..... F23J 1/04
(52) U.S. Cl. ..... 294/9; 294/55
(58) Field of Search ..... 294/1.1, 1.3, 1.4, 294/1.5, 9, 55; 15/257.1, 257.3–257.7; 126/242–244; 141/108, 109, 390, 391; 248/99, 101

(56) References Cited

U.S. PATENT DOCUMENTS 4,268,081 * 5/1981 Hawkinson ..... 294/55
4,307,704 * 12/1981 Wagg ..... 294/9 X
4,629,233 * 12/1986 Pfisterer ..... 294/55 X
5,031,277 * 7/1991 Coker ..... 294/55 X
5,090,756 * 2/1992 Pfisterer ..... 294/55 X
5,107,666 * 4/1992 Rahtican ..... 294/55 X
5,785,369 * 7/1998 Ridley et al. ..... 294/55 X

* cited by examiner

*Primary Examiner*—Johnny D. Cherry
(74) *Attorney, Agent, or Firm*—Swabey Ogilvy Renault; Guy J. Houle

(57) ABSTRACT

An ash and debris collector, particularly, but not exclusively, for a fireplace is comprised of a scoop body defined by an elongated open-ended channel member having a forward neck shovel portion and a rear discharge portion. At least a forward end of the shovel portion has a flat bottom wall with a straight front edge and opposed side walls. A skirt is provided in a front portion of the top wall of the shovel portion and projects outwardly of the top end of a front edge of the opposed side walls to prevent ashes from rising to the top wall of the scoop body during the scooping movement. A bag holder is secured to the rear discharge portion and extends rearwardly of a rear discharge opening defined by the rear discharge portion whereby to support a bag in an open condition. An open mouth of the bag is secured about the rear discharge opening by a band and a handle is provided on the rear discharge portion to manipulate the scoop.

12 Claims, 3 Drawing Sheets

ASH AND DEBRIS COLLECTOR AND BAGGER

TECHNICAL FIELD

The present invention relates to an ash and debris collector and bagger capable of collecting ashes in an efficient manner and automatically bagging the ashes, substantially dust-free.

BACKGROUND ART

Various fireplace ash removing apparatus are known. For example, such apparatus are described in U.S. Pat. Nos. 4,457,548; 4,416,252; 4,299,419 and 4,536,023. Some of these apparatus are provided with conveying means to convey the ash in a rigid compartment casing and the compartment casing is detached to discard the collected ashes. When the compartment is emptied, a dust cloud usually forms and sheds dust in the environment. Many of these ash collectors are also complex in construction and provided with gates which are actuated by the user by pulling on a lever or other type mechanisms. Because these mechanisms operate in a dust environment, they often clog up rendering the apparatus inoperable and therefore requiring maintenance. Furthermore, because fireplace hearths are usually provided with support grates to support logs to be burned thereon, it is often difficult with many of the known scoops to collect the ashes under the grate without removing the grate from the hearth. Such removal is also messy and requires extra labor.

SUMMARY OF INVENTION

It is a feature of the present invention to provide an ash and debris scoop which substantially overcomes the above-mentioned disadvantages of the prior art.

Another feature of the present invention is to provide an ash and debris scoop which is simple in construction, simple to operate and which provides a clean and efficient manner of removing ashes from a fireplace hearth.

Another feature of the present invention is to provide an ash and debris scoop, and particularly for a fireplace, and wherein plastic grocery bags can be easily attached thereto for secondary use and wherein the scoop directs the ashes collected directly into the bag in a manner which substantially prevents the formation of ash clouds.

According to the above features, from a broad aspect, the present invention provides an ash and debris scoop. The scoop comprises a scoop body defined by an elongated open-ended channel member having a forward neck shovel portion and a rear discharge portion. At least a forward end of the shovel portion has a flat bottom wall with a straight front edge and opposed side walls. A skirt in a front portion of a top wall of the shovel portion projects outwardly of a top end of a front edge of the opposed side walls to prevent ashes from rising to the top wall of the scoop body during a scooping movement. Bag holding means is secured to the rear discharge portion and extends rearwardly of the rear discharge opening defined by the rear discharge portion to support a bag in an open condition. Means is provided to secure an open mouth of the bag about the rear discharge opening. Handle means is secured to the rear discharge portion.

BRIEF DESCRIPTION OF DRAWINGS

A preferred embodiment of the present invention will now be described with reference to the accompanying drawings in which.

DESCRIPTION OF PREFERRED EMBODIMENTS

Figure 2:
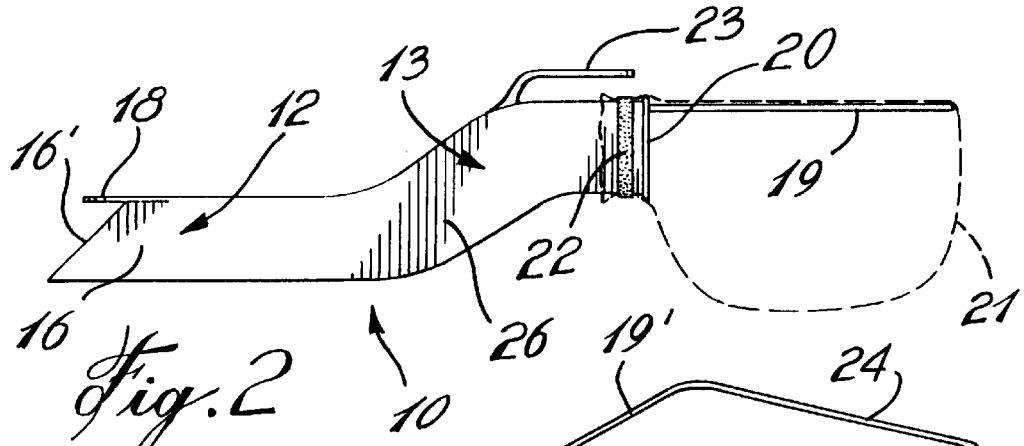
FIG. 2 is a side view of FIG. 1.
Figure 1:
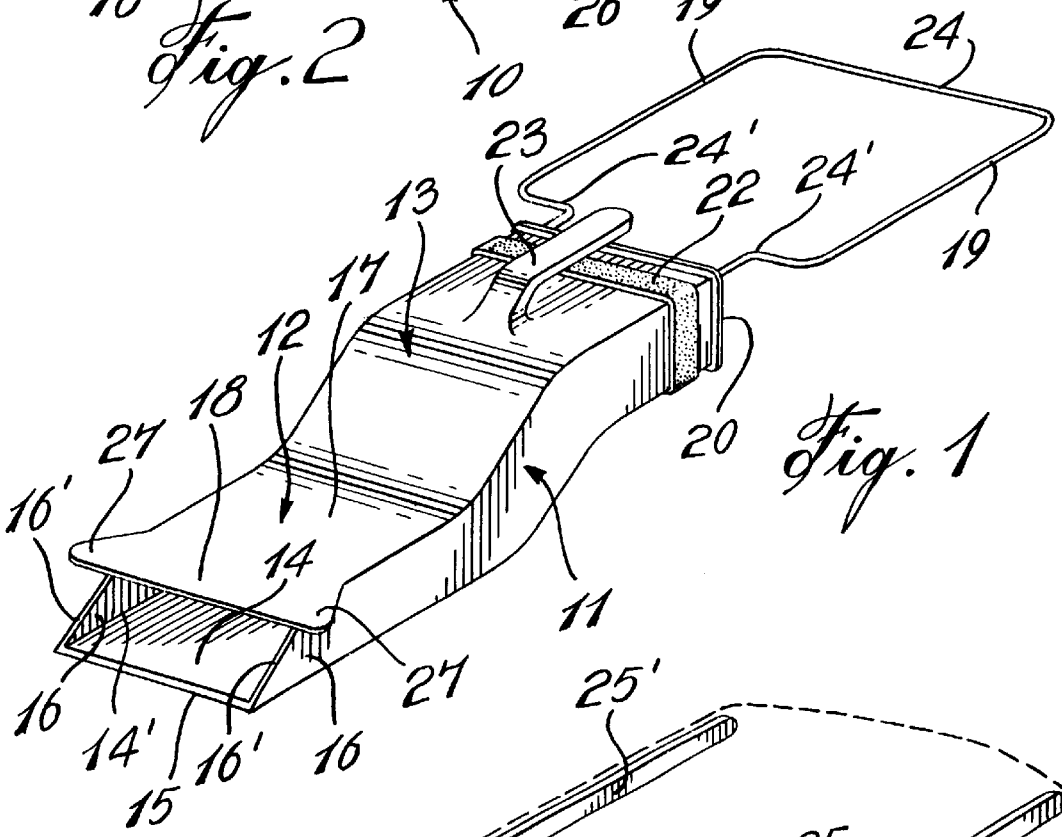
FIG. 1 is a perspective view of the ash scoop of the present invention.

Referring now to the drawings and more particularly to FIGS. 1 and 2, there is shown generally at 10 the ash scoop of the present invention for scooping ashes in fireplace hearths. It is also pointed out that the ash scoop can be utilized for scooping any material required to be picked up and bagged. For example, the ash scoop could be used in a workshop for picking up saw dust, dirt that accumulates on a floor surface, sand or other material capable of being scooped and requiring it to be placed in a bag. The ash scoop 10 is constituted by a scoop body defined by an elongated open-ended channel member 11 having a forward neck shovel portion 12 and a rear discharge portion 13. Preferably, but not exclusively, the channel member 11 tapers outwardly from the front end to the rear end to create voids in the scooped product to prevent the product from compacting within the channel. The forward end of the shovel portion 11 has a flat bottom wall 14 with a straight front edge 15. Opposed side walls 16 and 16' project from the opposed lateral edges 14' of the flat bottom wall and extend vertically in substantially parallel relationship. The forward edge 16' of the opposed side walls 16 are rearwardly inclined and extend upwardly and terminate at a top wall 17 under a projecting skirt 18. The projecting skirt 18 prevents ashes from lodging themselves on the top wall during a scooping operation.

Figure 5:
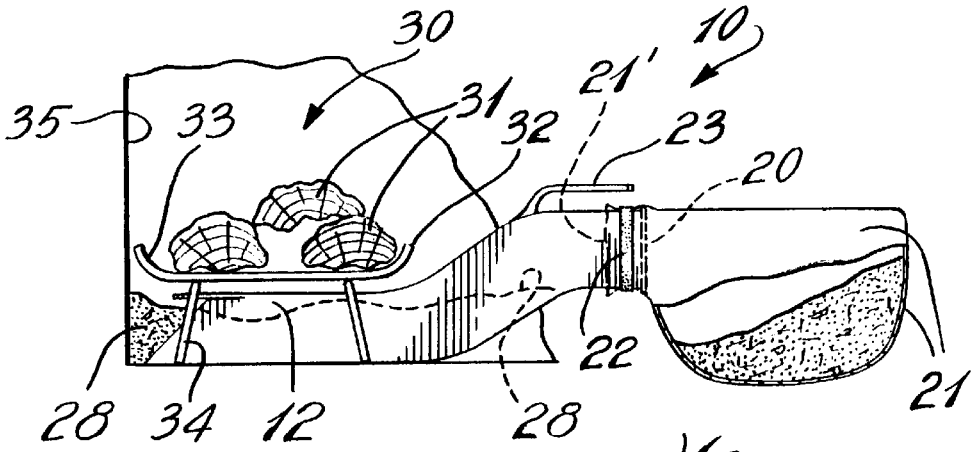
FIG. 5 is a fragmented side view showing the ash scoop in a scooping operation to scoop ashes located under a grate of a fireplace hearth.
Figure 6:
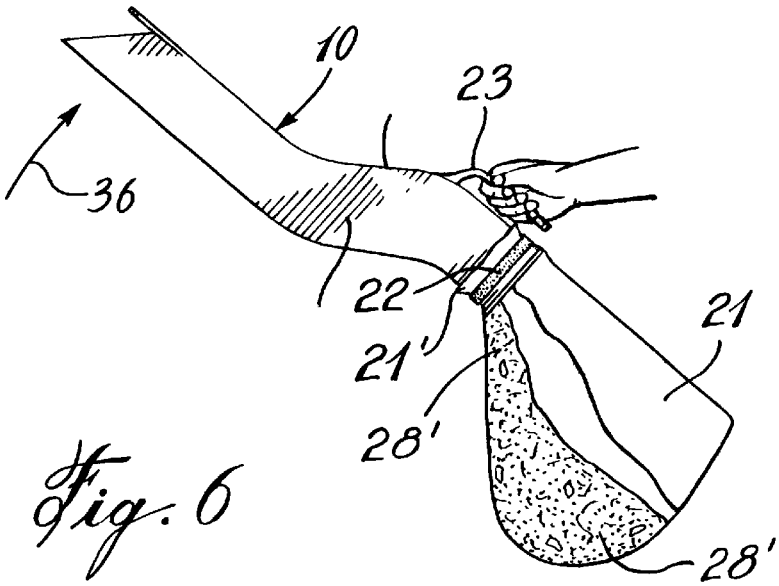
FIG. 6 is a perspective side view, partly fragmented, showing how the ashes which are scooped within the forward shovel portion of the scoop are automatically conveyed to the bag by tilting the scoop rearwardly.

Bag holding means in the form of opposed support arms 19 and 19' extend rearwardly from a respective one of opposed corner portions of a rear discharge opening 20 defined at the rear end of the rear discharge portion 13 whereby to support a bag 21, see FIGS. 5 and 6, in an open condition. The bag 21 is secured about the rear discharge opening 20 over a rear portion of the rear discharge portion 13 by securement means, hereinshown as a securement band 22. The band 22 may simply be an elastic band or a strap with the open mouth portion of the bag 21 being retained about the rear discharge opening and extending over the rear discharge portion 13. A handle 23 is secured to the top wall 17 at the rear discharge portion 13 to effectuate a scooping action.

Figure 3:
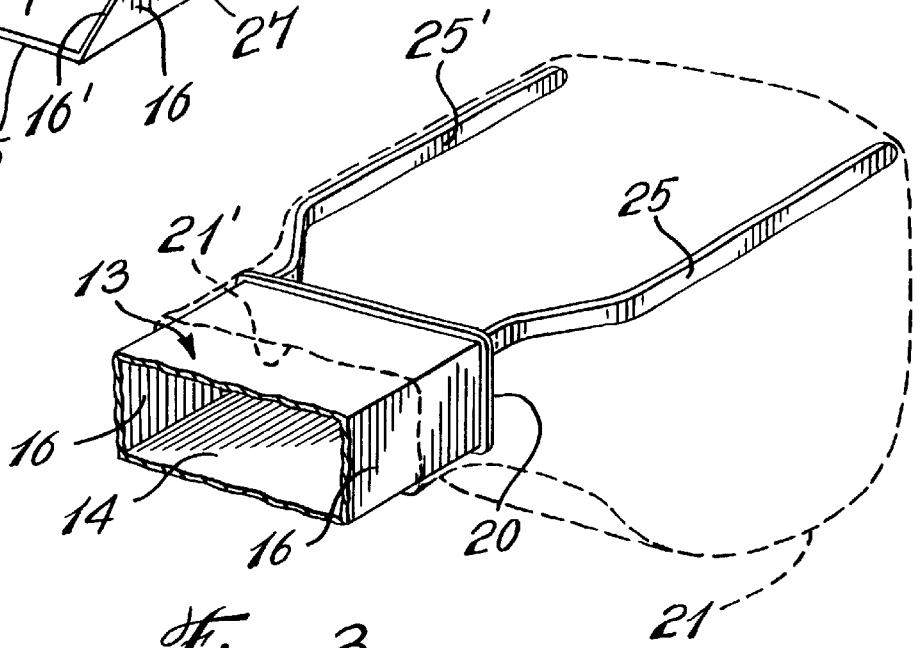
FIG. 3 is a fragmented perspective view showing an alternate construction of the bag holding means.

As shown in FIG. 1, the bag support arms 19 are constituted by a U-shaped wire support defining opposed wire arms 19 and 19' and a transverse end wire 24 formed integral with a rear end of the wire arms 19 and 19'. The forward ends 24 and 24' of the wire members are secured in a top rear corner of the rear discharge opening 20. As shown in FIG. 3, the opposed support arms 25 and 25' are constituted by flexible arms formed of rigid material and extending rearwardly from the top corner of the rear discharge opening 20. As can be seen more clearly from FIG. 2, the rear discharge portion 13 is elevated from the forward shovel portion 12 through a smoothly curved intermediate section 26. This provides for the unobstructed flow of ashes and debris during the scooping operation and the bagging operation, as illustrated in FIGS. 5 and 6. As also shown in FIGS. 1 to 3, the open-ended channel member is of substantially rectangular cross-section throughout its length.

Figure 4:
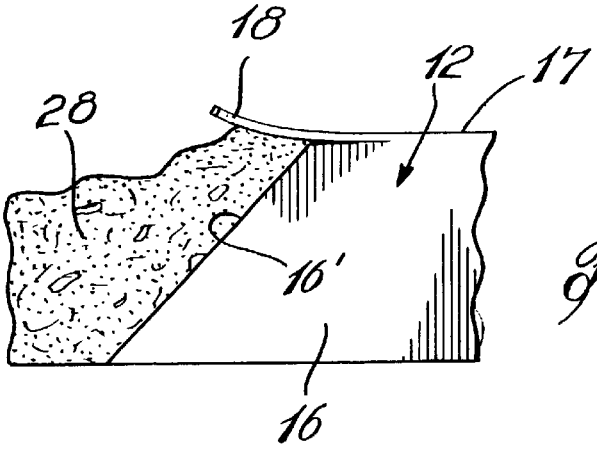
FIG. 4 is a fragmented end view showing ashes being scooped by the forward shovel portion of the scoop body.

The projecting skirt portion 18 projects outwardly from the top end of the front edges 16' of the opposed side wall 16 and defines outwardly extending side shoulders 27. The projecting skirt 18 may also be curved upwardly, as shown in FIG. 4, whereby ashes, such as the ashes 28, are arrested from moving to the top wall 17 during a scooping action to prevent ashes from falling off the scoop during the tilting motion when ashes are transferred to the bag. This is usually done outside the fireplace hearth.

Figure 7:
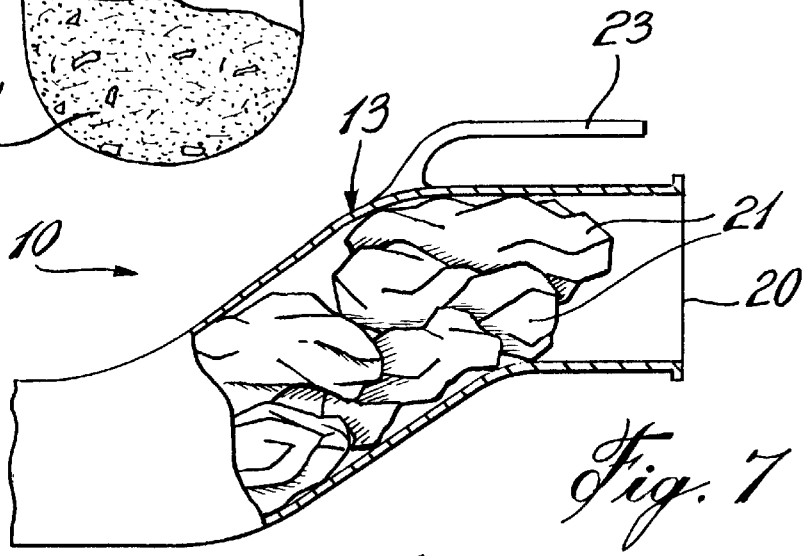
FIG. 7 is a fragmented section view of the rear discharge portion of the scoop showing its further utility for storing bags to be used with the scoop, when such scoop is not in use.

With further reference now to FIGS. 5 and 6 it is pointed out that to secure the bag 21 about the rear open end, the mouth opening 21' of the bag is placed over a rear portion of the rear discharge portion 13 as shown in FIG. 3. The retention band 22 is then disposed over the portion of the bag which extends over the rear discharge portion 13 and thus retained in a substantially sealed manner thereabout sufficiently to prevent dust from escaping at the attachment portion during the scooping and bag loading operations. One advantage of the ash scoop of the present invention is that grocery plastic bags that we commonly find in supermarkets may be used with the scoop. Usually these grocery bags are stored by the home keeper for various secondary use. The scoop of the present invention provides such an ideal secondary use and when the scoop is not being used, the bags 20 may be conveniently stored within the rear end discharge portion 13 of the scoop as shown in FIG. 7.

Figure 8:
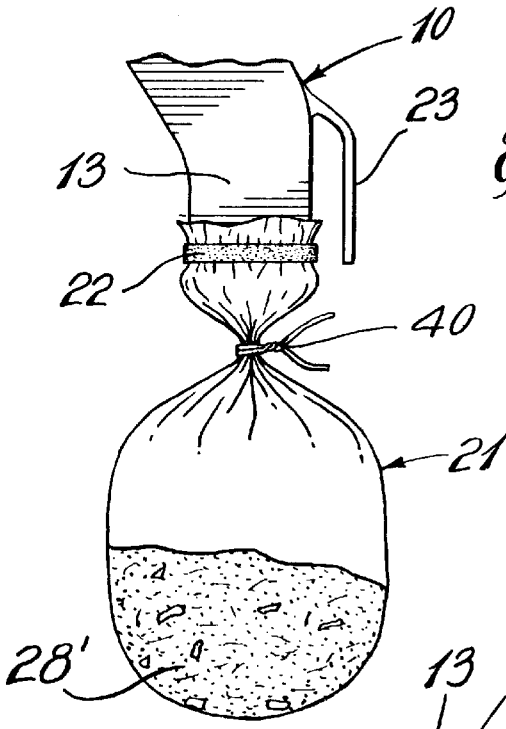
FIG. 8 is a fragmented side view showing how the bag can be sealed before it is removed from the scoop.

The operation of the ash scoop will now be described with reference to FIGS. 5 to 7. FIG. 5 shows a hearth 30 of a fireplace and wherein fireplace logs 31 are supported on a grate 32. The grate 32 has a log support platform 33 supported elevated by legs 34. Ashes 28 collect under this grate. With the scoop 10 of the present invention, it is possible to slide the forward shovel portion 12 under the grate 32 without having to lift the grate. As the scoop is pushed towards the rear wall 35 of the hearth, the ashes 28 will be forced into the scoop channel, such as shown at 28'. Several scooping operations can be effected before the scoop is withdrawn to transfer the ashes into the bag 21. As shown in FIG. 6, in order to do this, the scoop is simply retracted and tilted upwardly in the direction of arrow 36 and the ashes 28' are conveyed rearwardly into the bag 20. Because the scoop is only open at the front end, substantially all the dust generated by the displacement of the ashes will remain in the front end portion and will have a tendency of depositing back into the scoop. Once the bag is filled to a desired capacity, it can be tied closed by a twister fastener 40, as shown in FIG. 8 to prevent any ashes from escaping when manipulating the bag to detach it from the rear discharge portion 13. The elastic band 22 is slipped off the discharge portion 13 and the bag with the ashes therein can be discarded in a clean, efficient-manner.

Figure 9:
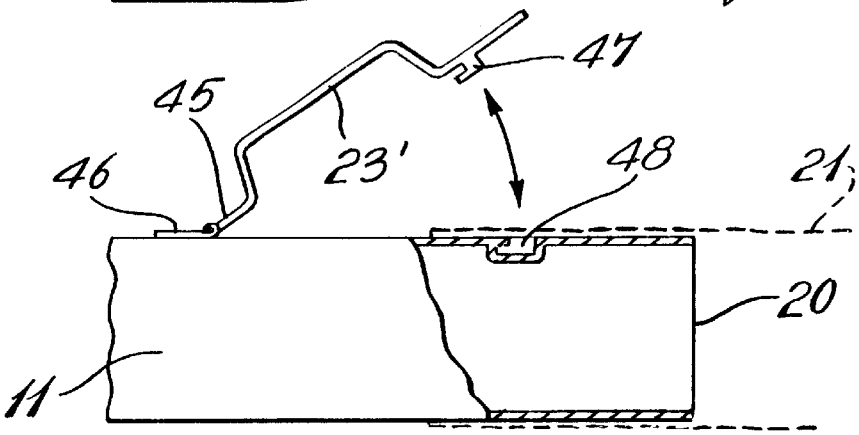
FIG. 9 is a fragmented side view showing a modification to the handle where it also constitutes a bag holder.

As shown in FIG. 9, the handle 23' may be pivotally connected at a forward end 45 to a hinge connection 46 secured to the top wall of the channel member 11. The rear of the handle 23' is provided with a projecting latch 47 for snap engagement in an engagement cavity 48 spaced forwardly from the rear end of the top wall 11' of the channel member 11. By pulling the neck of the bag 21 over the engagement cavity 48 and snapping the handle in engagement with the cavity, the bag 21 becomes attached to the top wall 11' and ashes are directed therein by the scoop.

It is within the ambit of the present invention to cover any obvious modifications of a preferred embodiment described herein, provided such modifications fall within the scope of the appended claims.

What is claimed is:

1. An ash and debris scoop, said scoop comprising a scoop body defined by an elongated open-ended channel member having a forward neck shovel portion and rear discharge portion, at least a forward end of said shovel portion having a flat bottom wall with a straight front edge and opposed side walls, a skirt in a front portion of a top wall of said shovel portion projecting outwardly of a top end of a front edge of said opposed side walls to prevent ashes from rising to said top wall of said scoop body during a scooping movement, bag holding means secured to said rear discharge portion and extending rearwardly of a rear discharge opening defined by said rear discharge portion to support a bag in an open condition, means to secure an open mouth of said bag about said rear discharge opening, and handle means secured to said rear discharge portion.

2. An ash and debris scoop as claimed in claim 1 wherein said bag holding means is constituted by opposed support arms extending rearwardly from a respective one of opposed top corner portions of said rear discharge opening, said arms entering inside a bag to support said bag in an open condition to receive ashes therein by tilting said scoop body rearwardly with said shovel portion elevated.

3. An ash and debris scoop as claimed in claim 2 wherein said bag holding means is a U-shaped wire support, said opposed support arms being constituted by opposed support wire arms defined by said wire support, and a transverse end wire formed integral with a rear end of said opposed support wire arms.

4. An ash and debris scoop as claimed in claim 2 wherein said opposed support arms are flexible arms.

5. An ash and debris scoop as claimed in claim 1 wherein said rear discharge portion is an elevated rear discharge portion, said rear discharge portion merging with said forward neck shovel portion through a smoothly curved intermediate section.

6. An ash and debris scoop as claimed in claim 1 wherein said opposed side walls have a rearwardly inclined front edge extending upwardly and terminating under said skirt.

7. An ash and debris scoop as claimed in claim 6 wherein said skirt defines opposed shoulder sections projecting outwardly from said opposed side walls.

8. An ash and debris scoop as claimed in claim 1 wherein said elongated open-ended channel member is of substantially rectangular cross-section.

9. An ash and debris scoop as claimed in claim 1 wherein said means to secure an open mouth of said bag about said rear discharge opening is an attachment band securable about a rear end of said rear discharge portion to clasp an open mouth section of said bag about said rear discharge opening.

10. An ash and debris scoop as claimed in claim 9 wherein said attachment band is an elastic band.

11. An ash and debris scoop as claimed in claim 1 wherein said handle means is a handle secured to a top wall of said rear discharge portion of said scoop.

12. An ash and debris scoop as claimed in claim 1 wherein said means to secure an open mouth of the bag is constituted by a hinged handle having a projecting latch engageable in an engagement cavity formed in a top wall of said channel member spaced from said rear discharge portion, said bag having a neck portion clampingly secured in said cavity by said projecting latch.

* * * * *